US006178717B1

(12) United States Patent
Loop

(10) Patent No.: US 6,178,717 B1
(45) Date of Patent: Jan. 30, 2001

(54) SHIM-LESS DOOR HANGING SYSTEM

(76) Inventor: Duwayne Lester Loop, 2605 McKinney Lake Rd., Grand Rapids, MN (US) 55744-4316

( * ) Notice: Under 35 U.S.C. 154(b), the term of this patent shall be extended for 0 days.

(21) Appl. No.: 09/205,626

(22) Filed: Dec. 3, 1998

(51) Int. Cl.[7] ..... E06B 1/60

(52) U.S. Cl. ..... 52/714; 52/217; 52/745.16; 49/505

(58) Field of Search ..... 52/215, 217, 745.15, 52/745.16, 712, 714, 213, 204.56; 49/467, 468, 505; 24/350; 411/457, 461, 473, 920

(56) References Cited

U.S. PATENT DOCUMENTS

| | | | | |
|---|---|---|---|---|
| 990,209 | | 4/1911 | MacKenzie . | |
| 1,093,674 | * | 4/1914 | Winans | 411/457 |
| 1,308,276 | | 7/1919 | Connell . | |
| 1,926,673 | | 9/1933 | Gregg . | |
| 3,320,705 | | 5/1967 | Downing, Jr. . | |
| 3,741,068 | * | 6/1973 | Andruskiewicz | 52/213 |
| 3,966,157 | | 6/1976 | Corral et al. . | |
| 4,224,772 | | 9/1980 | Bene et al. . | |
| 4,471,590 | | 9/1984 | Roberts et al. . | |
| 4,840,002 | | 6/1989 | Lovgren . | |
| 4,986,044 | | 1/1991 | Funari . | |
| 5,050,832 | | 9/1991 | Lee et al. . | |
| 5,365,697 | | 11/1994 | Vanderpan . | |

* cited by examiner

*Primary Examiner*—Michael Safavi
(74) *Attorney, Agent, or Firm*—Curtis Harr

(57) ABSTRACT

A door hanging system that utilizes a plurality of metallic elongated U-shaped clips that span the area between the edge of the door opening and the door jamb. These metallic clips also serve to support the weight of the pre-hung door or door jamb during the adjustment phase of the installation and to permanently anchor it once the proper orientation of the door has been achieved. Additionally, the clips are designed in a fashion that they can be concealed behind the door finishing trim commonly used in construction today.

15 Claims, 5 Drawing Sheets

FIG 2
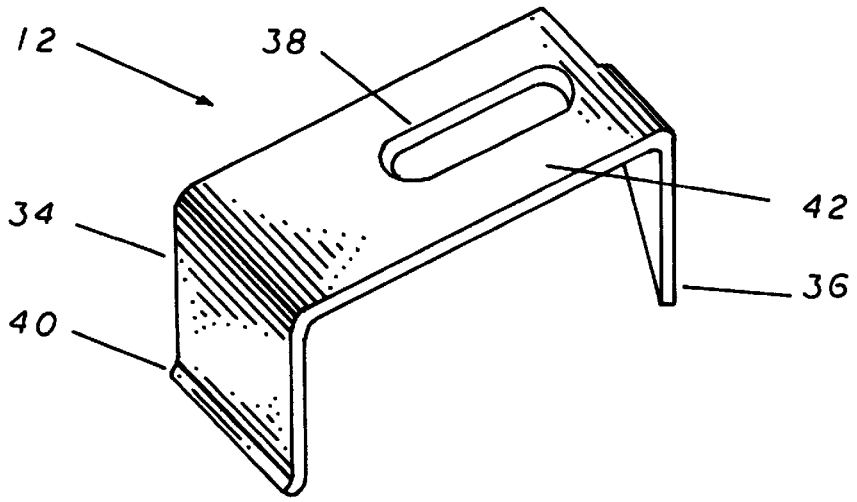
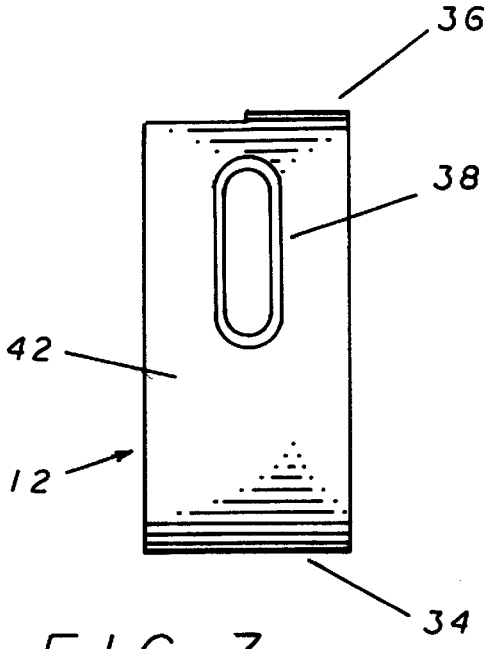
FIG 3
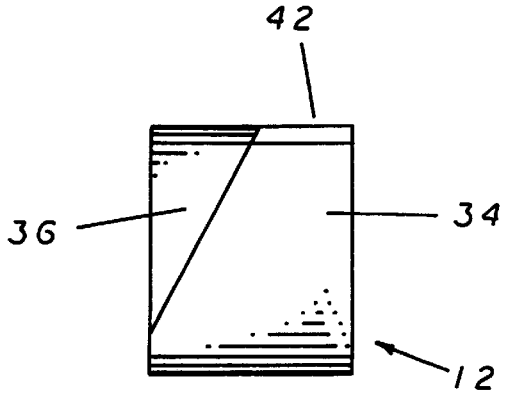
FIG 4

FIG 5
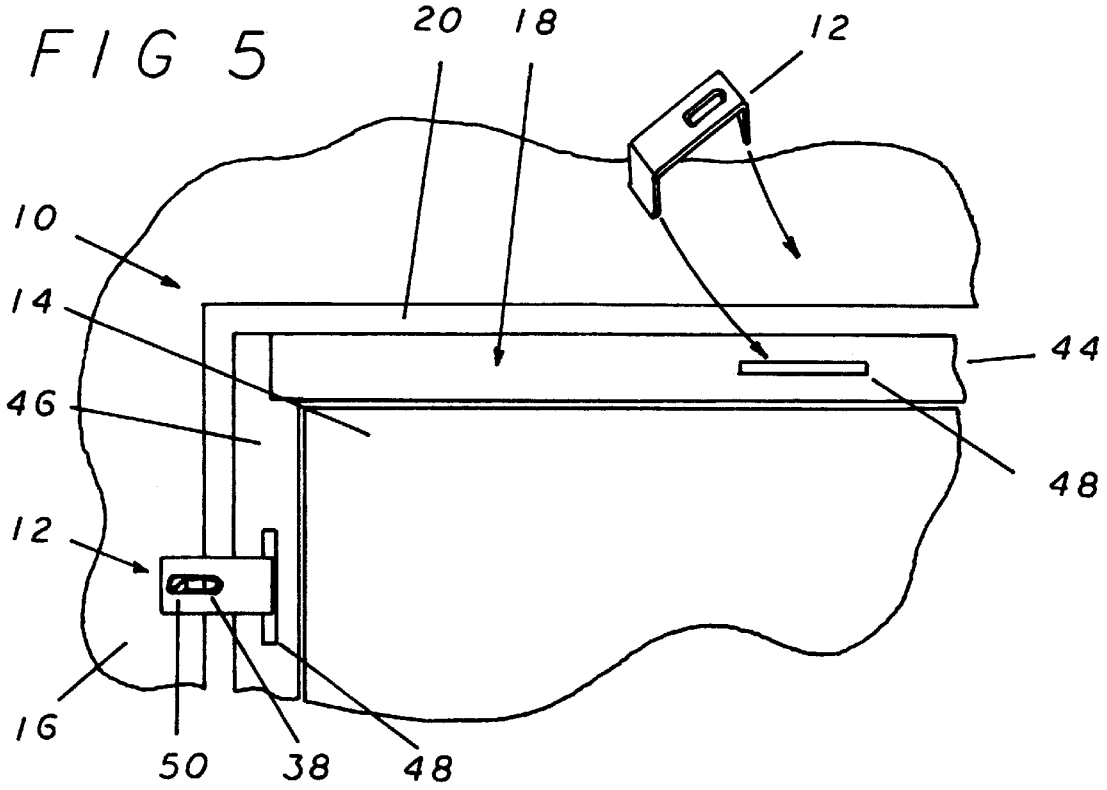
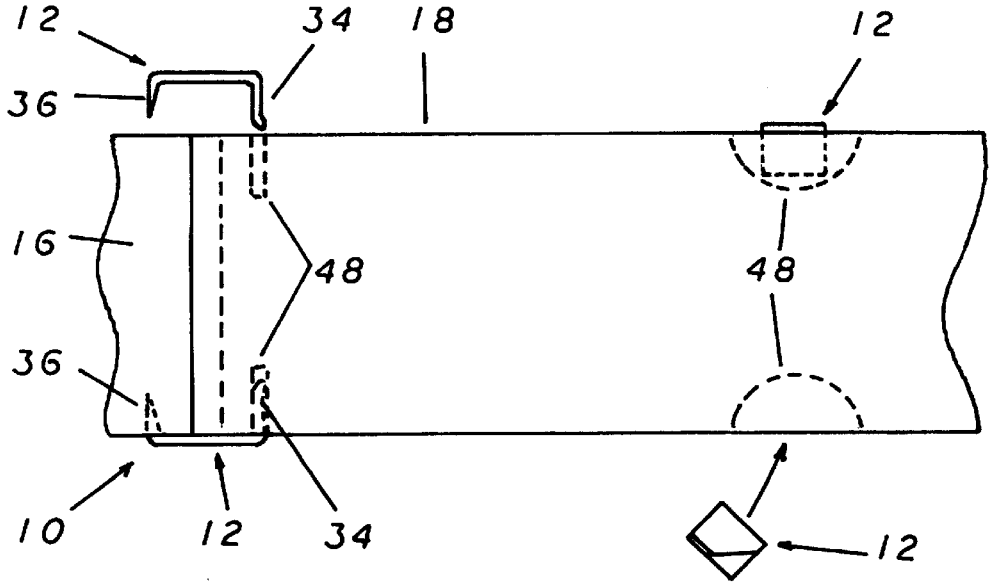
FIG 6

SHIM-LESS DOOR HANGING SYSTEM

BACKGROUND OF THE INVENTION

The present invention relates to an improvement in the method used to hang pre-hung doors in the rough door openings of the walls of homes or buildings under construction or during remodeling projects. More specifically, to the design of a metallic clip that can connect to both the door opening and a pre-hung door frame which will allow a person of average skills to easily install a pre-hung door or door jamb that is plumb and level.

In the past, in order to achieve an accurate installation of a pre-hung door unit or door jamb, so that it is plumb and level, workman and carpenters have had to use a painstaking trial and error method of nailing wood shims or expensive metal adjustable devices between the door units jamb and the walls rough opening in order to plumb and level the pre-hung door and secure it to the rough opening. When installing a pre-hung door the installer has two options. Option one is to leave the pre-hung door by older methods hanging or attached to the jamb and install the unit as a whole. Option two is to remove it from it's hinges and install just the jamb and then replace the door.

The advantage of leaving a pre-hung door attached to it's jamb during installation is that it allows the carpenter to use the door as a squaring device to determine that the proper clearance between the door and door jamb has been applied. Also by leaving the door attached the installer can ascertain whether the door is closing against the door stop correctly and thus, the installation is proper. The disadvantage of leaving the door attached is that the door creates a significant obstacle to the installer while placing and fastening shims to plumb and level the door jamb. Installation of a pre-hung door with the door in the jamb may require more than one workman in order to deal with the cumbersome obstacle.

The second type of installation of a pre-hung door is when the installer removes the door and installs just the door jamb. The advantage of this is that the jamb itself becomes less cumbersome as the weight is greatly reduced and the door is removed as an obstacle to installation. However, this method creates significant problems in that the odds are greater that the jamb will not be installed correctly and thus the door will not fit properly when re-installed onto the jamb. This method can be extremely time consuming and may also require a highly skilled craftsman in order to perform the tasks. All of this, including the skill level of the craftsman, the time involved and the need to readjust and constantly use trial and error when hanging a door significantly contributes to higher installation costs, labor costs, and thus an end cost to a home or building owner.

In the prior art, various methods of hanging door frames are known. One such method is disclosed in U.S. Pat. No. 3,320,705 issued Jun. 15, 1965 to Downing, Jr. for a door frame fastener. This patent discloses the use of metal clips that may be attached to the rough opening of a door in order to allow a metal door frame to then be attached to the clips. Although this method uses clips to hang a door frame, it in no way addresses the problem of plumbing and leveling a wooden or pre-hung door. This method addresses only the problem of connecting a U-shaped metal door frame to a rough opening.

Another type of adjustable door frame that is known is disclosed in U.S. Pat. No. 4,986,044 issued to Funari on Jan. 22, 1991. This patent discloses an adjustable door jamb assembly that can be aligned and installed in a door opening. This patent discloses the use of snap in guide clips to support the jamb assembly and adjust it. However, once again, this assembly appears to work only with metal type door frames and the clips must be pre-installed on the door and the door specially made to use this type of clip.

From this discussion it can be seen that it would be desirable to provide a method to hang pre-hung door frames of all types including wooden and composite type frames and to make such method easily usable so as to decrease the level of time and skill required when installing pre-hung door frames.

SUMMARY OF THE INVENTION

It is the primary objective of the present invention to provide a method of hanging pre-hung doors or door jambs by the use of a metallic clip that can be used externally to hold and secure the door in the proper position within an existing door opening.

It is an additional objective of the present invention to provide such a method that will allow a door to be easily adjusted while in the door opening to a perfectly plumb and level orientation prior to its being permanently attached to the door opening.

It is a further objective of the present invention to provide such a method that is usable by a person of average skills to hang a door that is perfectly plumb and level within the door opening.

It is a still further objective of the present invention to provide such a method that decreases the time necessary to hang a door and will therefore lower the costs of completing this task.

These objectives are accomplished by the use of a door hanging system that utilizes a plurality of metallic elongated U-shaped clips that span the area between the edge of the door opening and the door jamb. These metallic clips also serve to support the weight of the pre-hung door or door jamb during the adjustment phase of the installation and to permanently anchor it once the proper orientation of the door has been achieved. Additionally, the clips are designed in a fashion that they can be concealed behind the door finishing trim commonly used in construction today.

The metallic clips form a squared off elongated U-shape having a relatively long back and two relatively short legs extending from either end of the clip back. One of these legs form the clip foot which is used to anchor the clip in a precut kerf located in the door jamb and the other is a spike which is driven into the wall once the door jamb is set in the correct position. The clips are constructed with a relatively long back portion which contains an elongated screw attachment hole extending from near the spike end to approximately its center. When the door is properly located in this manner, a plurality of attachment screws are driven into the wall through the screw attachment holes which permanently anchor the pre-hung door or door jamb in the door opening.

For a better understanding of the present invention reference should be made to the drawings and the description in which there are illustrated and described preferred embodiments of the present invention.

DESCRIPTION OF THE DRAWINGS

FIG. 2 is a perspective view of the present invention showing the orientation of its major components in relation to one another.

FIG. 3 is a top elevation view of the present invention showing the location of the screw attachment hole in relation to the locating spike.

FIG. 4 is a front elevation view of the present invention showing the manner of construction of the locating spike and its orientation in relation to the body of the invention.

FIG. 5 is a front elevation cut-away view of the present invention showing the manner in which it engages the door opening and door jamb to position the door properly.

FIG. 6 is a top elevation view of the present invention showing the manner in which it engages the door jamb and the door opening.

Figure 1:
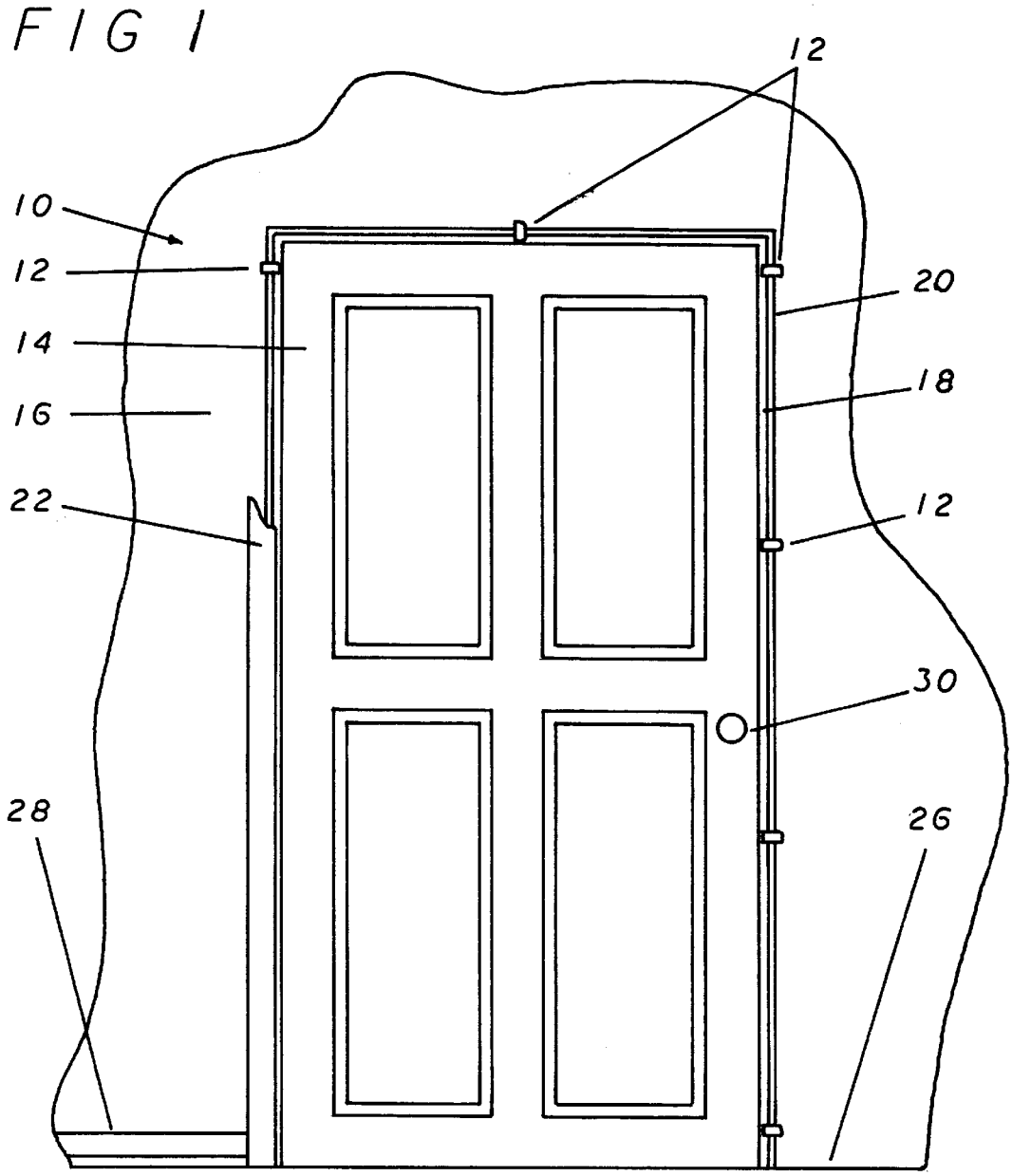
FIG. 1 is a front elevation cut-away view of a typical doorway and the present invention showing how the invention is employed to hold a pre-hung door or door jamb within a standard door opening.

DESCRIPTION OF THE PREFERRED EMBODIMENT:

Referring now to the drawings, and more specifically to FIG. 1, the shim-less door hanging system 10 is made up primarily of the door hanger clip 12 which is a relatively small metallic clip used to span the door opening 20 between the door frame 18 and the wall 16 and hold the door jamb 18 and door 14 in the correct position. This figure illustrates the relative position of the door 14 and the door jamb 18 to the wall 16, the floor 26 and the floor trim. The correct position of the door 14 in this relationship is critical because if the door jamb 18 is not plumb and square with the wall 16 and floor 26 the door 14 will either tend to swing open unwantedly when the door handle 30 is not properly engaged or the door's 14 swinging motion will be impeded by the floor 26. This figure also illustrates the manner in which the door casing 22 is used to cover the door opening 20 once the installation of the door 14 is complete which also serves to cover door hanging clips 12 used to hang the door jamb 18.

The construction of the door hanger clip 12 is illustrated in FIGS. 2, 3 and 4. The door hanging clip 12 is an elongated U-shaped device having the longer closed end of the U composing the clip back 42 from which on either end the shorter clip end 34 and the locating spike 36 extend. The clip back 42 also provides the surface upon which the countersunk screw adjustment hole 38 is located. The countersunk screw adjustment hole 38 is an elongated in the clip back 42 having inwardly beveled edges surrounding its entire perimeter. The elongated shape allows a fastening device to be placed anywhere within its length to accommodate the fastening of the door hanging clip 12 to door jambs 18 and door openings 20 of varying designs and widths. This versatility of attachment allows the use of the present invention in hanging a door 14 in a plumb and level manner in any situation that presents itself.

The clip end 34 forms one of the shorter sides of the elongated U and extends at a right angle from one end of the clip back 42. The clip end 34 also has at its leading end a relatively short outwardly turned edge called the clip foot 40. During the door 14 installation, the clip end 34 is inserted into a pre-made opening on the door jamb 18 that is just wide enough to allow the clip end 34 to fit. The clip foot's 40 outwardly protruding design helps to anchor the clip foot 34 within this opening as it frictionally engages the internal sides of the opening. This ensures that the door hanging clip 12 is securely held within the door jamb 18 during the installation process so that the door 14 can be hung in the proper orientation to provide for its correct operation.

At the opposite end of the clip back 42 from the clip end 34 is the clip locating spike 36. The locating spike 36 forms the other shorter end of the elongated U and also extends downward at a right angle from the clip back 42. The locating spike 36 is still shorter in length than the clip end 34 and is tapered from the point at which it diverges from the clip back 42 down to a very sharp point at its most outward end. Additionally, at its widest point the locating spike 36 is only about half as wide as the clip back 42. Once the door hanging clip 12 is placed within the door jamb 18, the locating spike 36 is driven into the wall 16 to hold the door jamb 18 and the door 14 in the proper position prior to its permanently being attached within the door opening 20. It should be apparent at this point that size, shape and orientation of the locating spike 36 may be varied as necessary for a given material and construction type.

Figure 7:
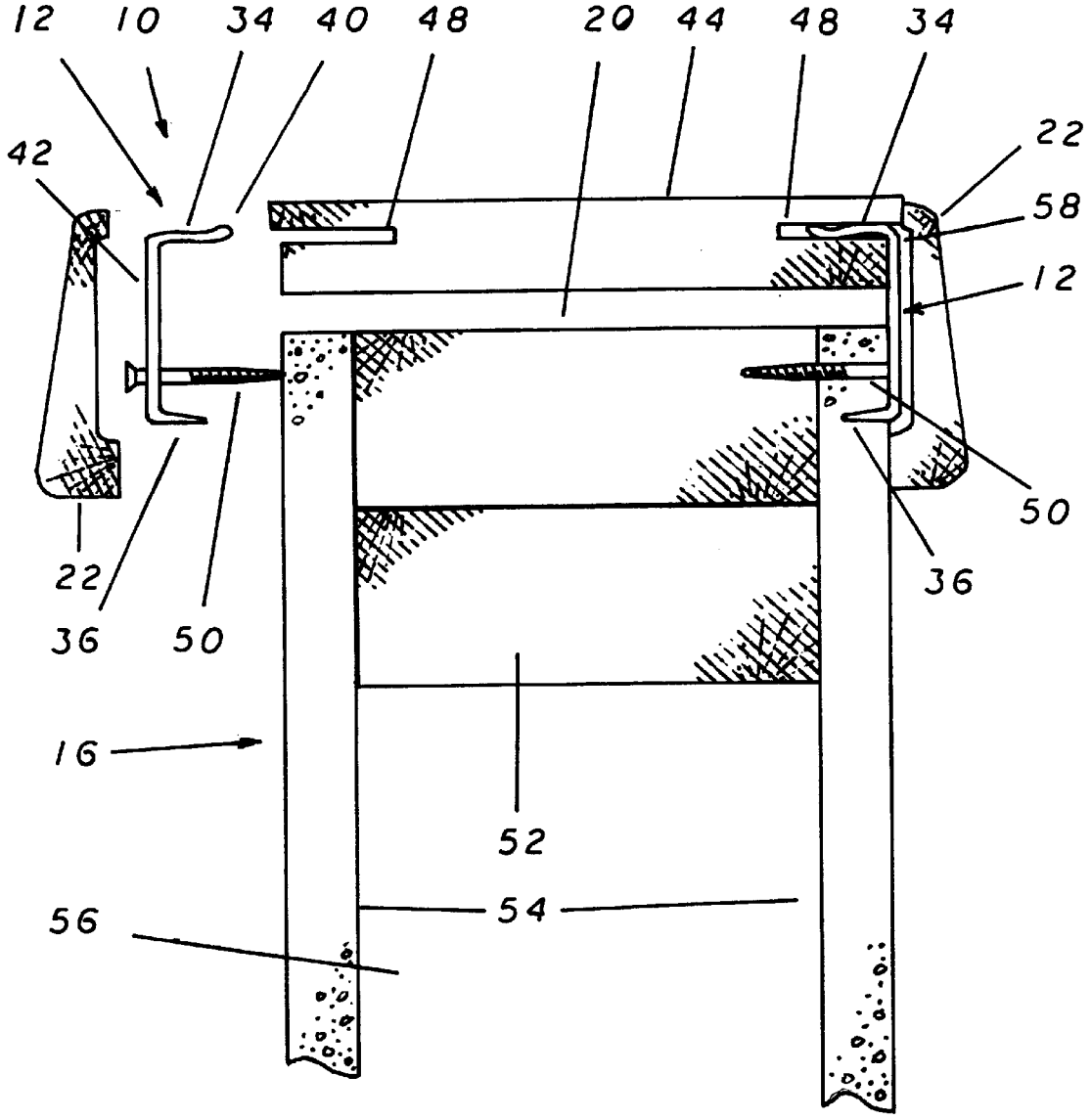
FIG. 7 is a top elevation cut-away view of the present invention showing the manner in which it engages the door jamb and the door opening and how the door molding covers the invention.

The manner in which the door hanging clip 12 is utilized to accurately hang a door jamb 18 in a proper position is further illustrated in FIGS. 5, 6 and 7. A wall 16 is typically constructed with a layer of drywall material 54 being attached on one or both sides of an internal wood or metal frame leaving a mostly open wall cavity 56 between the drywall 54. In the construction of a door opening 20 in a wall 16, the wall cavity is closed off by the use of door framing material 52 which surrounds the door opening 20 between the walls 16 drywall 54 outer sheath. The door 14 and door jamb 18 is inserted in this opening 20 where the door jamb 18 is permanently attached allowing the door 14 to open and close freely facilitating passage through the wall 16.

The door jamb 18 is composed of the side jambs 46, which frame the sides of the door space 14, and the head jamb 44, which spans the area between the side jambs 46 at the top of the door 14. In use with the present invention, both the head jamb 44 and the side jambs 46 are precut with a plurality of saw kerfs 48 which are evenly spaced along both the inside and outside edges. These saw kerfs 48 provide the point at which the clip end and foot, 40 and 42, of the door hanging clip 12 are installed prior to the installation of the door jamb 18. With the door hanging clips 12 in place in the head and side jambs, 44 and 46, the door jamb 18 is oriented in the door opening 20 in a plumb and level position. This is done by driving the locating spikes 36 into the wall 16 in a sequence which allows the user constantly check and maintain the plumb orientation of the door jamb 18 and the door 14. This system allows a door 14 to be installed in a door opening quickly and accurately by even a person of limited construction experience.

Once all of the locating spikes 36 of the plurality of door hanging clips 12 are driven into the wall 16 and the door jamb 18 is properly positioned, the attachment screws 50 are driven through the drywall 54 and into the door framing 52 which permanently anchors the door jamb 18 and door 14 within the door opening 20. The attachment screws 50 are equipped with a beveled head that allows them to fit within the beveled edge of the countersunk screw adjustment holes 38 in a manner that the head of the screw 50 is level with the outside edge of the clip back 42. This ensures that the head of the attachment screw 50 will not interfere with the placement of the door casing 22 used to cover the door opening 20 left between the door jamb 18 and the wall 16. At this point the jamb 18 may be further attached with conventional fasteners (NOT SHOWN) if desired.

Additionally, the portion of the clip back 42 that extends beyond the surface of the door jamb 18 and the wall 16 when the door hanging clip 12 is fully installed fits within the depression groove 58 formed between the door casing 22 and the door jamb 18 and wall 16. The depression groove 58 is created by the shallow channel typically machined in the back side of the door casing 22 and the slight outward protrusion on the leading edge of the door jamb 18. This configuration allows the door casing 22 to hide from view the door hanging clips 12 and also covers the rough door opening 20 to give the door 14 a finished and professional look.

Figure 8:
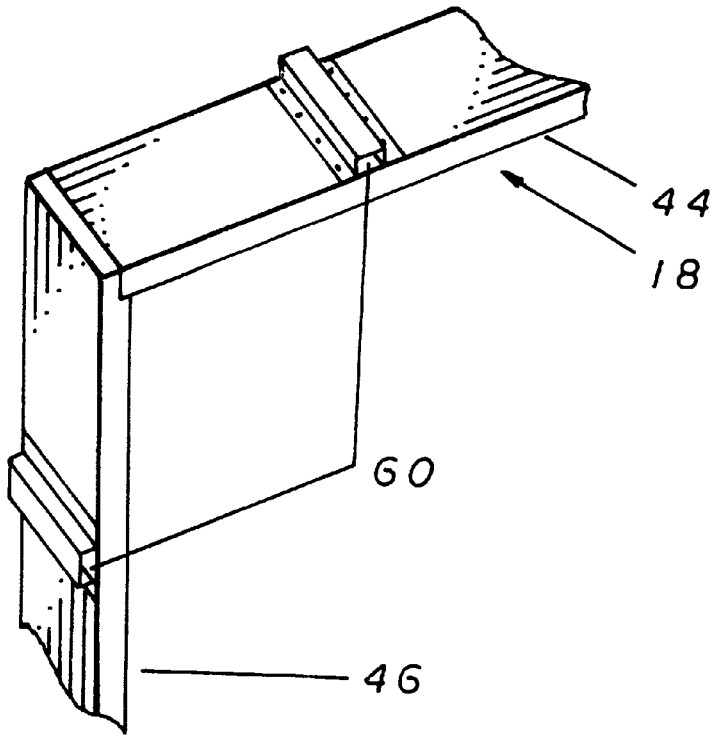
FIG. 8 is a perspective view of an alternative embodiment of the present invention in which the attachment point for the invention on the door jamb is an external added channel clip retainer.

An alternative embodiment of the present invention is illustrated in FIG. 8. In this embodiment the saw kerfs 48 that are cut into the door jamb 18 in the previous embodiment are replaced by a plurality of external clip retainers 60 that can be made of a variety of material including, but not limited to, nylon, plastic and metal. These external clip retainers 60 are attached to the outer surfaces of the door jamb 18 and form a narrow opening channel that spans the width of the door jamb 18. This design provides a small opening on either side of the clip retainer 60 into which the clip end and foot, 34 and 40, are inserted in much the same fashion as with the saw kerfs 48 as previously described. A great advantage of the external clip retainers 60 is that they can be used with door jambs 18 in which saw kerfs 48 have not been precut or with door jambs made of material that is difficult or impossible to cut kerfs 48. From this point on the installation process is the same as described above.

Figure 9:
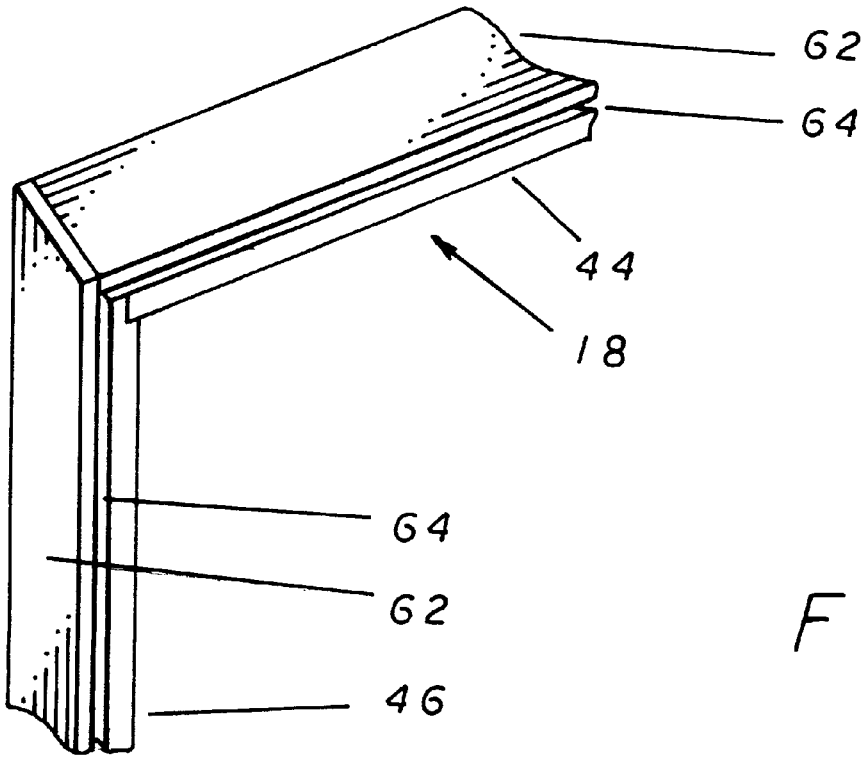
FIG. 9 is a perspective view of an alternative embodiment of the present invention in which the attachment point for the invention is a depression created between the door jamb and an added additional jamb edge.

A further embodiment of the present invention is illustrated in FIG. 9. This embodiment also deals with door jambs 18 that do not have precut saw kerfs 48 or that are made of a material that makes it difficult or impossible to cut kerfs 48. In this embodiment the opening into which the clip end 34 of the door hanging clip 12 is inserted is established by installing an additional jamb edge 62 to the outer surface of the existing door jamb 18. The additional jamb edge 62 can be made of a variety of materials including, but not limited to, nylon, wood, plastic or metal and built to be the same width and thickness as the existing door jamb 18.

The internal built-in kerf 64 is formed by notching the inside edge to a depth that will allow for the insertion of the clip end and foot, 34 and 40, of the door hanging clip 12 in much the same manner as with the two previously described embodiments. The internal kerf 64 is formed by attaching the additional jamb 62 to the outer surface of the door jamb 18 with its notched corner on the side closest to the existing door jamb 18. This construction method leaves a continuous gap (the internal built in kerf 64) between the existing door jamb 18 and the additional jamb 62 into which the clip end 34 of the door hanging clip 12 is inserted during the hanging operation.

Although the present invention has been described in considerable detail with reference to certain preferred versions thereof, other versions are possible. Therefore, the spirit and scope of the appended claims should not be limited to the description of the preferred versions contained herein.

What is claimed is:

1. A shim-less door hanging system for use in hanging a door jamb having two side sections and top header section in a rough opening having two side sections and a top header section, said shim-less door hanging system comprising:

a U shaped door hanger clip;

said clip having a base top section with a first side section and a second side section;

said first side section extending perpendicularly away from said base section in a level plane to an outward end;

said first section forming a foot section at said outward end said foot section curving away from the plane of said first section; and said second section forming a spike attachment means extending perpendicularly away from said base section.

2. A shim-less door hanging system as in claim 1 wherein said base section defines an opening for attaching said U shaped door hanger clip to said rough opening.

3. A shim-less door hanging system as in claim 2 wherein said opening is an elongated opening for adjustment.

4. A shim-less door hanging system as in claim 3 wherein said opening is beveled to accept a countersunk screw.

5. A shim-less door hanging system for use in hanging a pre-hung type door in a in a rough opening having two side sections and top header section, said shim-less door hanging system comprising:

a door jamb having two side sections and a top header section;

at least one U shaped door hanger clip;

said at least one U shaped clip having a base top section with a first side section and a second side section;

said first side section extending perpendicularly away from said base section in a level plane to an outward end for connection to said door jamb;

said first section forming a foot section said foot curving away from the plane of said first section; and said second section forming a spike attachment extending perpendicularly away from said base section for attachment to said rough opening.

6. A shim-less door hanging system as in claim 5 wherein said door jamb further defines at least one kerf for receiving said first side section of said at least one U shaped door hanger clip.

7. A shim-less door hanging system as in claim 5 wherein said door jamb further comprises at least one external clip retainer forming a channel for receiving said first side section of said at least one U shaped door hanger clip.

8. A shim-less door hanging system as in claim 5 wherein said door jamb further comprises a built in kerf defined by the outer portion of said door jamb.

9. A shim-less door hanging system as in claim 5 wherein said base section defines an opening for attaching said U shaped door hanger clip to said rough opening.

10. A shim-less door hanging system as in claim 9 wherein said opening is an elongated opening for adjustment.

11. A shim-less door hanging system as in claim 10 wherein said opening is beveled to accept a countersunk screw.

12. A shim-less door hanging system as in claim 11 further comprising molding having a recessed back portion to cover said at least one U shaped door hanger clip.

13. A method of hanging a pre-hung door in a plumb and level position within a rough opening of a wall said method comprising the steps of:

supplying a pre-hung door frame having at least one slotted section about said door frame;

supplying at least one U shaped clip, said at least one U shaped clip having a base top section with a first side section and a second side section, said first side section extending perpendicularly away from said base section for connection to said door jamb, said first side section having a foot section which curves away from the plane of said first side section so as to form a lip, said second section forming an attachment extending perpendicularly away from said base section for attachment to said rough opening;

placing said pre-hung door frame in said rough opening in a plumb and level position;

attaching said first section of said at least one U shaped clip to said at least one slotted section about said door frame; and attaching said second section of said at least one U shaped clip to said rough opening.

14. A method of hanging a pre-hung door as in claim 13 further comprising the additional step of affixing said at least one U shaped clips base top section to said rough opening with a fastener.

15. A method of hanging a pre-hung door as in claim 14 further comprising the additional step of permanently fastening said pre-hung door frame to said rough opening with fasteners.

* * * * *